US006033056A

United States Patent [19]

Desie

[11] Patent Number: 6,033,056

[45] **Date of Patent: *Mar. 7, 2000**

[54] DEVICE FOR DIRECT ELECTROSTATIC PRINTING (DEP) COMPRISING AN INDIVIDUAL SHIELD AND CONTROL ELECTRODE PER APERTURE

[75] Inventor: Guido Desie, Herent, Belgium

[73] Assignee: Agfa-Gevaert, Mortsel, Belgium

[ * ] Notice: This patent issued on a continued prosecution application filed under 37 CFR 1.53(d), and is subject to the twenty year patent term provisions of 35 U.S.C. 154(a)(2).

[21] Appl. No.: 08/551,347

[22] Filed: Nov. 1, 1995

[30] Foreign Application Priority Data

Nov. 4, 1994 [EP] European Pat. Off. ..... 94203220

[51] Int. Cl.[7] ..... B41J 2/04

[52] U.S. Cl. ..... 347/55

[58] Field of Search ..... 347/128, 55, 127, 347/1.11, 120, 141, 159, 161, 163, 151; 216/17

[56] References Cited

U.S. PATENT DOCUMENTS 4,743,926 5/1988 Schmidlin et al. .
5,095,322 3/1992 Fletcher .
5,170,185 12/1992 Takemura et al. .
5,193,011 3/1993 Dir et al. .
5,214,451 5/1993 Schmidlin et al. .
5,229,794 7/1993 Honma et al. .
5,257,046 10/1993 Schmidlin .
5,347,292 9/1994 Ge et al. .
5,353,105 10/1994 Gundlach et al. ..... 347/151

*Primary Examiner*—John Barlow
*Assistant Examiner*—Raquel Yvette Gordon
*Attorney, Agent, or Firm*—Baker & Botts, L.L.P.

[57] ABSTRACT

A device for use in the technique of direct electrostatic printing (DEP) images onto an intermediate or final substrate. The direct electrostatic printing device includes a receiving member support and a printhead structure which has shield electrodes on a first side and control electrodes on a second side, and which also has apertures therethrough. There is one shield electrode and one control electrode for each aperture. The direct electrostatic printing device also includes a toner delivery mechanism which provides a cloud of toner particles in the vicinity of the apertures. The printhead structure is made of a plastic isolating substrate. The voltage applied to the individual control electrodes is varied according to the contents of the image being printed. A correction voltage is applied to each individual shield electrode and is tuned according to the characteristics of the particular aperture which corresponds to that shield electrode. The values corresponding to the correction voltages for each shield electrode can be stored in a look up table, which will be unique for each printhead structure.

7 Claims, 2 Drawing Sheets

DEVICE FOR DIRECT ELECTROSTATIC PRINTING (DEP) COMPRISING AN INDIVIDUAL SHIELD AND CONTROL ELECTRODE PER APERTURE

FIELD OF THE INVENTION

This invention relates to an apparatus used in the process of electrostatic printing and more particularly in Direct Electrostatic Printing (DEP). In DEP, electrostatic printing is performed directly from a toner delivery means on a receiving member substrate by means of an electronically addressable printhead structure and the toner has to fly in an imagewise manner towards the receiving member substrate.

BACKGROUND OF THE INVENTION

In DEP (Direct Electrostatic Printing) the toner or developing material is deposited directly in an imagewise way on a receiving member substrate, the latter not bearing any imagewise latent electrostatic image. The substrate can be an intermediate endless flexible belt (e.g. aluminium, polyimide, etc.). In that case the imagewise deposited toner must be transferred onto another final substrate. Preferentially the toner is deposited directly on the final receiving member substrate, thus offering a possibility to create directly the image on the final receiving member substrate, e.g. plain paper, transparency, etc. This deposition step is followed by a final fusing step.

This makes the method different from classical electrography, in which a latent electrostatic image on a charge retentive surface is developed by a suitable material to make the latent image visible. Further on, either-the powder image is fused directly to said charge retentive surface, which then results in a direct electrographic print, or the powder image is subsequently transferred to the final substrate and then fused to that medium. The latter process results in an indirect electrographic print. The final substrate may be a transparent medium, opaque polymeric film, paper, etc.

DEP is also markedly different from electrophotography in which an additional step and additional member is introduced to create the latent electrostatic image. More specifically, a photoconductor is used and a charging/exposure cycle is necessary.

A DEP device is disclosed by Pressman in U.S. Pat. No. 3,689,935. This document discloses an electrostatic line printer having a multi-layered particle modulator or printhead structure comprising:

- a layer of insulating material, called isolation layer;
- a shield electrode consisting of a continuous layer of conductive material on one side of the isolation layer;
- a plurality of control electrodes formed by a segmented layer of conductive material on the other side of the isolation layer; and
- at least one row of apertures.

Each control electrode is formed around one aperture and is isolated from each other control electrode.

Selected potentials are applied to each of the control electrodes while a fixed potential is applied to the shield electrode. An overall applied propulsion field between a toner delivery means and a receiving member support projects charged toner particles through a row of apertures of the printhead structure. The intensity of the particle stream is modulated according to the pattern of potentials applied to the control electrodes. The modulated stream of charged particles impinges upon a receiving member substrate, interposed in the modulated particle stream. The receiving member substrate is transported in a direction orthogonal to the printhead structure, to provide a line-by-line scan printing. The shield electrode may face the toner delivery means and the control electrode may face the receiving member substrate. A DC field is applied between the printhead structure and a single back electrode on the receiving member support. This propulsion field is responsible for the attraction of toner to the receiving member substrate that is placed between the printhead structure and the back electrode.

This kind of printing engine, however, requires a rather high voltage source and expensive electronics for changing the overall density between maximum and minimum density, making the apparatus complex and expensive. Moreover, since not all apertures behave exactly the same, it is very difficult to obtain an image with an overall equal density. This results in a poor output quality, especially in solid areas.

To overcome these problems several modifications have been proposed in the literature.

In U.S. Pat. No. 4,912,489 the conventional positional order of shield electrode and the control electrode—as described by Pressman—has been reversed. This results in lower voltages needed for tuning the printing density. In a preferred embodiment, this patent discloses a new printhead structure in which the toner particles from the toner delivery means first enter the printhead structure via larger apertures, surrounded by so-called screening electrodes, further pass via smaller apertures, surrounded by control electrodes and leave the structure via a shield electrode. The larger aperture diameter is advised in order to overcome problems concerning crosstalk.

In EP-A-0 587 366 an apparatus is described in which the distance between printhead structure and toner delivery means is made very small by using a scratching contact. As a result, the voltage—needed to overcome the applied propulsion field—is very small. The scratching contact, however, strongly demands a very abrasion resistant top layer on the printhead structure.

An apparatus working at very-close distance between the printhead structure and the toner delivery means is also described in U.S. Pat. No. 5,281,982. Here a fixed but very small gap is created in a rigid configuration, making it possible to use a rather low voltage to select wanted packets of toner particles. However, the rigid configuration requires special electrodes in the printhead structure and circuits to provide toner migration via travelling waves.

In U.S. Pat. No. 4,568,955 e.g. a segmented receiving member support comprising different galvanically isolated styli as control back electrodes is used in combination with toner particles that are migrated with travelling electrostatic waves. The main drawback of this apparatus is its limited resolution and dependence of the image quality on environmental conditions and properties of the receiving member substrate.

In U.S. Pat. No. 4,733,256 some of these drawbacks are overcome by the introduction or a printhead structure, as described by Pressman. The printhead structure is located between the receiving member support

- which comprises different isolated wires as control back electrode
- and the toner delivery unit. For a line printer the density can be tuned by selecting an appropriate voltage for shield electrode, control-electrode and control back electrode wire.

In U.S. Pat. No. 5,036,341 a device is described comprising a screen or lattice shaped control back electrode matrix as segmented receiving member support. This apparatus has the advantage that matrix-wide image information can be written to the receiving member substrate, but it also suffers from the environmental influences and those caused by the nature of the receiving member substrate.

To overcome these drawbacks Array Printers described in U.S. Pat. No. 5,121,144 another device wherein the segmented back electrode without printhead structure was changed into a two part electrode system, having a printhead-electrode structure and a back electrode structure. A first part was placed between the toner delivery means and the receiving member substrate and consisted of parallel, isolated wires, being used as printhead structure. A second part consisted of another set of parallel wires, arranged orthogonally with respect to the first wires and was used as back electrode structure. The receiving member support or back electrode structure in all examples consists of isolated wires which are oriented in one direction. As printhead structure, there are described three different configurations:

1. isolated wires in a cross direction;
2. a flexible PCB with only control electrodes in the cross direction; and
3. a flexible PCB with common shield electrode and control electrodes in the cross direction.

The different systems according to this patent make it possible to change the propulsion field in a group of apertures, tuning the density by setting the voltage of the different control electrodes.

According to U.S. Pat. No. 4,491,855 the image density can be enhanced by the introduction of an AC-voltage, applied to the toner conveying member. As a result, shorter writing times are possible. But, to obtain a reduced image density, the same voltage levels must be applied.

In U.S. Pat. No. 5,170,185, a method is described to vary the image density. For that purpose, the voltage, applied to three different stages of the device, can be varied on a time base scale, between a writing time and a non-writing time. These three stages include:

a back electrode located-on the receiving member support;

the toner delivery means; and the common shield electrode of the printhead structure.

With experimentally obtained variations it is possible to modify the image density obtained by a standard configuration. However, as the different voltages are applied to the back electrode, toner delivery means or common shield electrode, it is not possible to correct a single pixel for a certain density change during a single writing cycle.

In U.S. Pat. No. 5,193,011, a method is disclosed to achieve a pixel by pixel correction by time-modulation of voltages, applied to the different control electrodes around individual apertures. If pixels on the receiving member substrate, imaged by different apertures, exhibit a different visual density, the control electrodes corresponding to these apertures can be driven during different time intervals. As such, a page wide constant image density can be obtained. This method only controls one single electrode per pixel, i.e. the control electrode on the printhead structure. The voltage applied to each control electrode has to take into account:

the required density value on the receiving member substrate; and the individual correction parameter per aperture.

This means that the correct time modulation must be based on the grey scale value and the density correction.

In U.S. Pat. No. 5,229,794 an apparatus is described which comprises a printhead structure, comprising apertures. Each individual aperture has two distinct electrodes, further on called shield electrode and control electrode. To achieve an enhanced image contrast, two fixed voltages $V_1$ and $V_2$ can be applied alternatively to each pair of shield and control electrodes. If $V_1$ is applied to the shield electrode, then $V_2$ is applied to the control electrode and vice versa.

All above mentioned patent applications just fulfil one or a few of the different requirements for an inexpensive DEP device, delivering high-quality images with stable densities.

There is thus still a need to have a DEP system, based on a simple apparatus, yielding high quality images in a reproducible and constant way.

OBJECTS OF THE INVENTION

It is an object of the invention to provide an improved Direct Electrostatic Printing (DEP) device. printing high quality images.

It is a further object of the invention to realise a smooth and constant page wide density.

Further objects and advantages of the invention will become clear from the description hereinafter.

The above objects are realized by providing a device—for direct electrostatic printing on the front side of an intermediate or final receiving member substrate 9—comprising:

a printhead structure 6, at the front side of the receiving member substrate 9, comprising:
- a plurality of apertures 7;
- one individual control electrode 6*a* per aperture 7 on one side of the printhead structure; and
- one individual shield electrode 6*b* per aperture 7 on the other side of the printhead structure, wherein each individual electrode 6*a* or 6*b* is galvanically isolated from each other electrode;

a toner delivery means 1, at the front side of said printhead structure 6, providing toner particles 4 in the vicinity of said apertures 7;

characterised in that said device comprises means for applying a plurality of voltage levels independently to said control electrodes and shield electrodes.

DETAILED DESCRIPTION OF THE INVENTION

Figure 1:
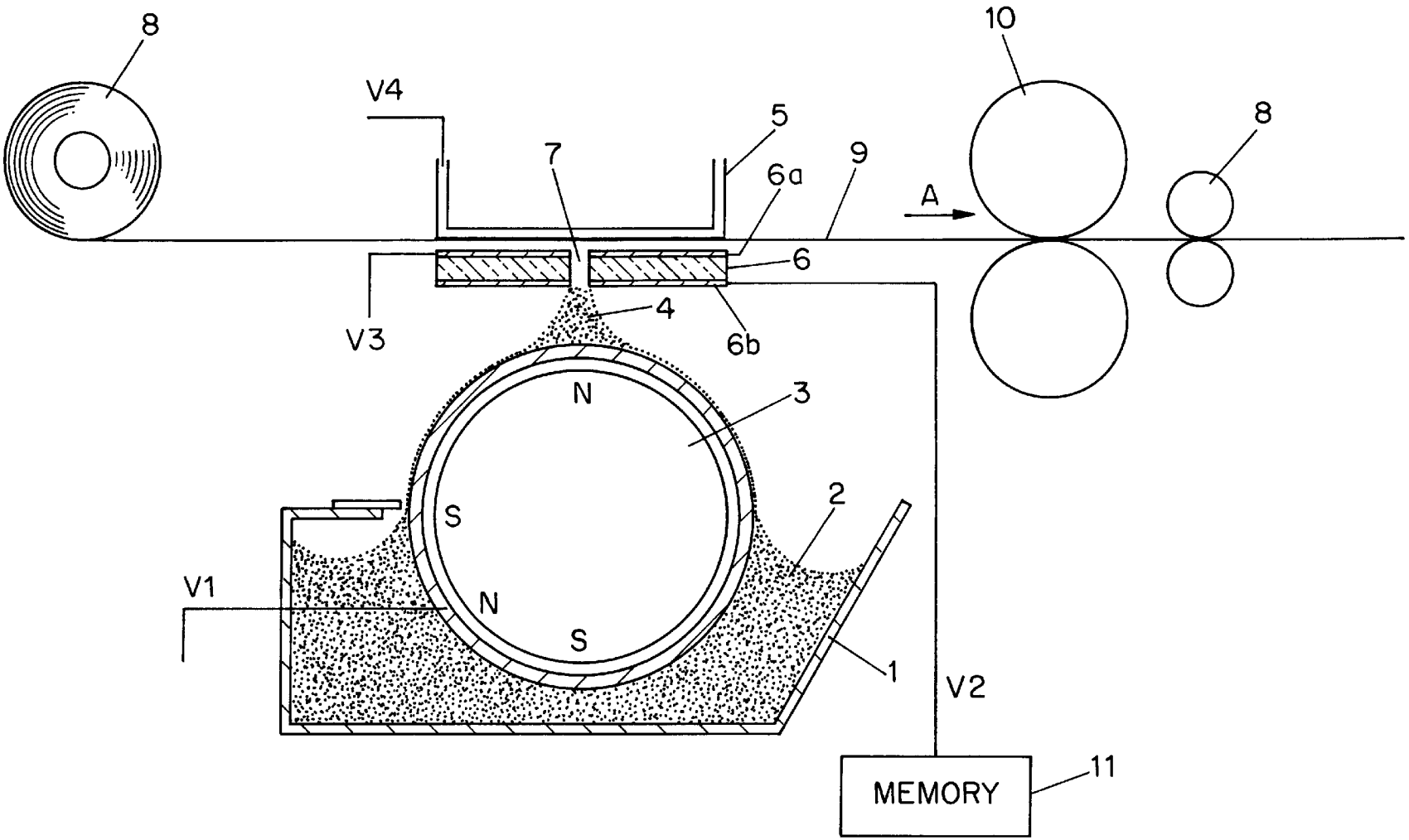
FIG. 1 is a schematic illustration of a possible embodiment of a DEP device according to the present invention.

In the literature many devices have been described that operate according to the principles of DEP (Direct Electrographic Printing). However, with all these devices it is very difficult to obtain page-wide homogeneous densities. Since most DEP devices are able to perform grey scale printing either by voltage modulation or by time modulation of the voltage applied to the control electrodes, a grey scale correction for each individual aperture can be made, in order to obtain homogeneous densities. However, it is advantageous to have one correction parameter per aperture, which can be stored in a memory means 11, e.g. a look up table (LUT). Such a correction parameter can be applied to a specific aperture without further calculation.

It has been found that, if the correction value for each individual aperture is stored in a LUT, and—during printing—the stored voltage value is used to generate a correction voltage applied to the corresponding shield electrode, then a smooth page-wide printout without large density fluctuations in the direction orthogonal to the paper transport, can be obtained. This method also has the advantage that the correction value can both increase and decrease the density. If e.g. a specific aperture always yields a density which is higher than most of its neighbours, the correction voltage applied to its shield electrode can be changed such that the overall density from this aperture decreases. On the other hand, if said aperture provides a density value which is too small, relative to most of its neighbours, the correction voltage applied to its shield electrode can be chosen to increase the image density. The correction voltage applied to each individual shield electrode per aperture makes it possible to tune the device for higher particle throughput. If no correction voltage could be applied to the individual shield electrodes, the apertures giving the lowest density, when maximum density is driven, would dictate the maximum toner throughput for all other apertures. These other apertures would never operate at their maximum toner throughput capabilities. In order to achieve a required density, realised by a certain degree of toner coverage, the receiving member substrate must then move slower, due to the lower toner throughput. A correction for each individual aperture is more difficult to accomplish by a time-modulated correction, applied to the individual control electrodes, as described in the prior art.

For each aperture, the control electrode and the shield electrode has thus a different function. The voltage applied to the control electrode varies with the required pixel density, realised via the specific aperture. As such, the voltage applied to the control electrode is determined by the image signals that represent the image to be printed. The voltage applied to the shield electrode is a correction voltage for the specific aperture. This voltage is constant, whatever the value of the image signals may be. During the printing of one sheet, the voltage applied to the shield electrode is kept constant, but during the time between two printouts, the voltage applied to the shield electrode may be varied, e.g. to clean the aperture from toner particles. For each specific aperture, a specific correction voltage must be established. This can be done by making a test print, for which all control electrodes and shield electrodes are driven by a voltage of 0 V. The density realised by each aperture is measured, and according to this density, a correction voltage is computed. This correction voltage can be derived by a method as described in conjunction of table 1 below. Once the correction voltage for each aperture has been established, a value corresponding to said voltage can be determined for each aperture. These values can be stored in a volatile or non-volatile memory means, "such as a ROM, PROM, EPROM or EEPROM. During printing, the values are read from the memory means" and generate a correction voltage for each specific shield electrode. If the values are stored in a volatile memory means, for access by the electronics to drive the correction voltages, the values must also be copied in a non-volatile memory means. Each time, when the DEP device is switched on, the values in non-volatile memory means are then transmitted to the volatile memory means. In the latter case, it is also possible to store different sets of correction values, depending on the operation conditions, such as ambient temperature or humidity. Said operation conditions are measured, based upon these measurements a specific set of correction values is selected, and the selected set is copied to the volatile memory means. If during operation the environmental conditions change, another appropriate set can be installed in the volatile memory means.

Description of the DEP device

A device for implementing DEP according to one embodiment of the present invention comprises (FIG. 1):

(i) a toner delivery means 1, comprising a container for developer 2 and a magnetic brush assembly 3, this magnetic brush assembly forming a toner cloud 4.

(ii) a receiving member support 5, for guiding the receiving member substrate 9 at a close distance from the printhead structure 6.

(iii) conveyer means 8 to convey a member receptive for said toner image—called receiving member substrate 9—between a printhead structure 6 and said receiving member support 5 in the direction indicated by arrow A.

(iv) means for fixing 10 said toner onto said image receiving member substrate 9.

(v) a printhead structure 6, made from a plastic insulating film. Originally, the plastic film is coated at both sides with a metallic film. Apertures 7 are drilled through the three layers. The metallic films are then etched such that individually addressable ring electrodes are formed around each aperture, on both sides of the plastic film. The ring electrodes, facing the toner cloud 4 are called shield electrodes 6*b*. The ring electrodes facing the receiving member substrate 9 are called control electrodes 6*a*.

Figure 2A:
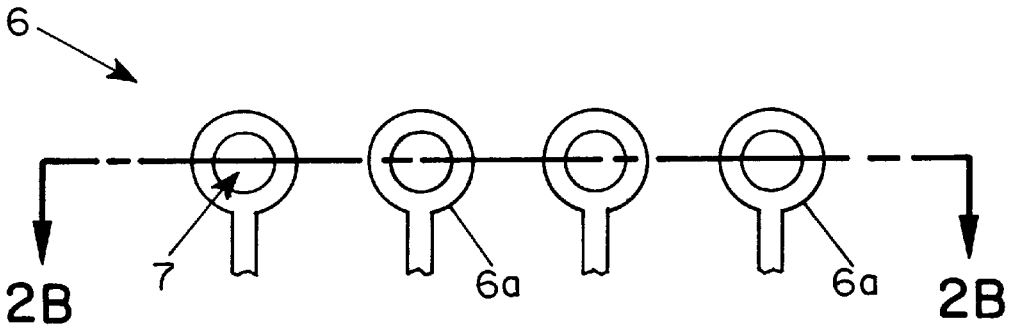
FIG. 2A is a top view of a possible embodiment of the printhead structure contained in the DEP device depicted in FIG. 1.
Figure 2B:
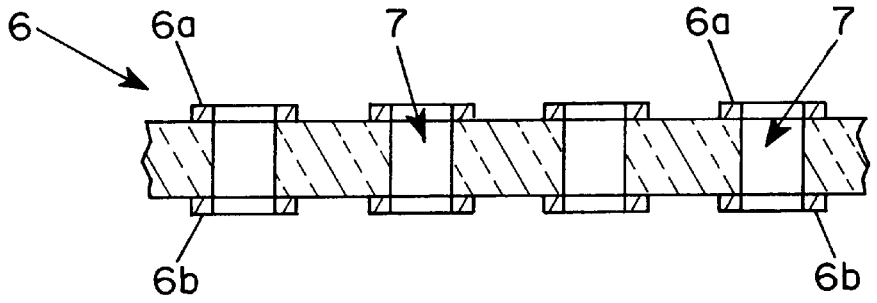
FIG. 2B is a cross-sectional view of a possible embodiment of the printhead structure contained in the DEP device depicted in FIG. 1.
Figure 2C:
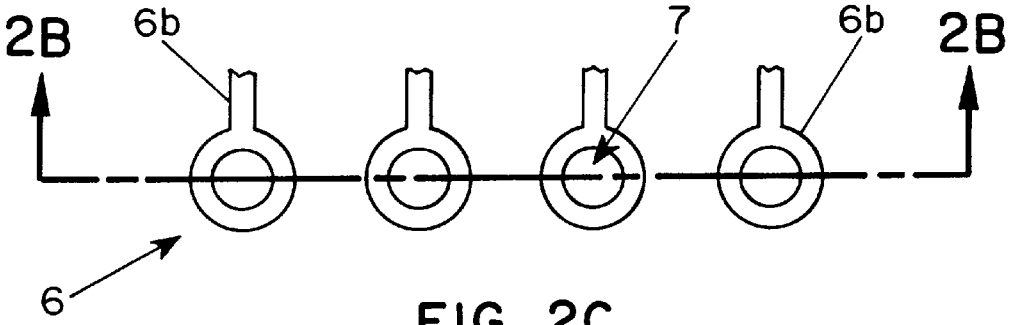
FIG. 2C is a bottom view of a possible embodiment of the printhead structure contained in the DEP device depicted in FIG. 1.

FIGS. 2A, 2B and 2C depict a more detailed view of one possible embodiment of the printhead structure 6 depicted in FIG. 1. For each aperture 7 drilled through printhead structure 6, FIGS. 2A, 2B and 2C depict exactly one individually addressable control electrode 6*a* formed around the aperture 7 on one side of printhead structure 6, and exactly one individually addressable shield electrode 6*b* formed around the aperture 7 on the opposite side of printhead structure 6. As clearly depicted in FIGS. 2A, 2B and 2C, each individually addressable control electrode 6*a* is electrically isolated from every other individually addressable control electrode 6*a,* and from each individually addressable shield electrode 6*b*. As is similarly depicted in FIGS. 2A, 2B and 2C, each individually addressable shield electrode 6*b* is electrically isolated from every other individually addressable shield electrode 6*b*, and from each individually addressable control electrode 6*a*.

Although in FIG. 1 and FIGS. 2A, 2B and 2C, a preferred embodiment of a DEP device—using control electrodes 6*a* and shield electrodes 6*b* in printhead structure 6—is shown, it is possible to realise a DEP device according to the present invention using different constructions of the printhead structure 6. The apertures in these printhead structures can have a constant diameter, or can have a larger entry or exit diameter.

Different electrical fields can be created between the magnetic brush assembly 3, shield electrode 6*b,* control electrode 6*a* and even the receiving member support 5, if this is coated by a metallic film too.

In a specific embodiment of a DEP device, according to the present invention, shown in FIG. 1, voltage $V_1$ is applied to the sleeve of the magnetic brush assembly 3, a voltage $V_2$, ranging from $V_{20}$ up to $V_{2n}$ to the individual shield electrodes 6*b*; and variable voltages $V_3$ ranging from $V_{30}$ up to $V_{3n}$ for the individual control electrodes 6*a*. Herein is $V_{20}$, $V_{30}$ the lowest voltage level applied to the shield or control electrode, and $V_{2n}$, $V_{3n}$ the highest voltage applied to said electrode. Usually a selected set of discrete voltage levels $V_{30}$, $V_{31}$, . . . can be applied to the control electrode. The value of the variable voltage $V_3$ is selected between the values $V_{30}$ and $V_{3n}$ from the set, according to the digital value of the image forming signals, representing the desired grey levels. Alternatively, the voltage can be modulated on a time basis according to the grey-level value. The voltage $V_2$ is selected according to the correction value stored in the look up table for the specific printhead structure. Voltage $V_4$ is applied to the receiving member support 5 behind the toner receiving member.

In a DEP device according to a preferred embodiment of the present invention, the toner delivery means 1 creates a layer of multi-component developer on a magnetic brush assembly 3, and the toner cloud 4 is directly extracted from said magnetic brush assembly 3. In other systems known in the art, the toner is first applied to a conveyer belt and transported on this belt in the vicinity of the apertures. A device according to the present invention is also operative with a mono-component developer or toner, which is transported in the vicinity of the apertures 7 via a conveyer for charged toner. Such a conveyer can be a moving belt or a fixed belt. The latter comprises an electrode structure generating a corresponding electrostatic travelling wave pattern for moving the toner particles.

The magnetic brush assembly 3 preferentially used in a DEP device according to an embodiment of the present invention can be either of the type with stationary core and rotating sleeve or of the type with rotating core and rotating or stationary sleeve.

Several types of carrier particles, such as described in EP-A-675417 can be used in a preferred embodiment of the present invention.

Also toner particles suitable for use in the present invention are described in the above mentioned European patent application.

A DEP device making use of the above mentioned marking toner particles can be addressed in a way that enables it to give black and white. It can thus be operated in a "binary way" useful for black and white text and graphics and useful for classical bilevel halftoning to render continuous tone images.

A DEP device according to the present invention is especially suited for rendering an image with a plurality of grey levels. Grey level printing can be controlled by either an amplitude modulation of the voltage $V_3$ applied on the control electrode 6*a* or by a time modulation of $V_3$. By changing the duty cycle of the time modulation at a specific frequency, it is possible to print accurately fine differences in grey levels. It is also possible to control the grey level printing by a combination of an amplitude modulation and a time modulation of the voltage $V_3$, applied on the control electrode.

The combination of a high spatial resolution and of the multiple grey level capabilities, opens the way for multilevel halftoning techniques, such as e.g. described in EP-A-634862. This enables the DEP device, according to the present invention, to render high quality images.

It can be advantageous to combine a DEP device, according to the present invention, in one apparatus together with a classical electrographic or electrophotographic device, in which a latent electrostatic image on a charge retentive surface is developed by a suitable material to make the latent image visible. In such an apparatus, the DEP device according to the present invention and the classical electrographic device are two different printing devices. Both may print images with various grey levels and alphanumeric symbols and/or lines on one sheet or substrate. In such an apparatus the DEP device according to the present invention can be used to print fine tuned grey levels (e.g. pictures, photographs, medical images etc. that contain fine grey levels) and the classical electrographic device can be used to print alphanumeric symbols, line work etc. Such graphics do not need the fine tuning of grey levels. In such an apparatus—combining a DEP device, according to the invention with a classical electrographic device—the strengths of both printing methods are combined.

EXAMPLE

A printhead structure 6 was made from a polyimide film of 100 μm thickness, double sided coated with a 15 μm thick copperfilm. The printhead structure 6 had a plurality of apertures. On the back side of the printhead structure, facing the receiving member substrate, a ring shaped control electrode 6*a* was arranged around each aperture. Each of said control electrodes was individually addressable from a high voltage power supply. On the front side of the printhead structure, facing the toner delivery means, each aperture had one individual shield electrode 6*b*.

The individually addressable control and shield electrode structures were made by conventional techniques used in the micro-electronics industry, using fotoresist material, film exposure, and subsequent etching techniques. No surface coatings were used in this particular example. The apertures 7 were 150 μm in diameter, being surrounded on both sides of the printhead structure by a circular electrode structure in the form of a ring with a diameter of 300 μm. The apertures were arranged (staggered) in such a way as to obtain a linear pitch of 200 μm. Both the individual shield electrode 6*b* and the control electrode 6*a* were connected to a power supply which was variable for each individual apertured electrode pair.

The toner delivery means 1 was a stationary core/rotating sleeve type magnetic brush as described below. The development assembly comprised two mixing rods and one metering roller. One rod was used to transport the developer through the unit, the other one to mix toner with developer.

The magnetic brush assembly 3 was constituted of the so called magnetic roller, which in this case contained inside the roller assembly a stationary magnetic core, showing nine magnetic poles of 500 Gauss magnetic field intensity and with an open position to enable used developer to fall off from the magnetic roller. The magnetic roller contained also a sleeve, fitting around said stationary magnetic core, and giving to the magnetic brush assembly an overall diameter of 20 mm. The sleeve was made of stainless steel roughened with a fine grain to assist in transport (<50 μm).

A scraper blade was used to force developer to leave the magnetic roller. And on the other side a doctoring blade was used to meter a small amount of developer onto the surface of said magnetic brush assembly. The sleeve was rotating at 100 rpm, the internal elements rotating at such a speed as to conform to a good internal transport within the development unit. The magnetic brush assembly 3 was connected to an AC power supply with a square wave oscillating field of 600 V at a frequency of 3.0 kHz with 0 V DC-offset.

A macroscopic "soft" ferrite carrier consisting of a MgZn-ferrite with average particle size 50 μm, a magnetisation at saturation of 29 emu/g was provided with a 1 μm thick acrylic coating. The material showed virtually no remanence.

The toner used for the experiment had the following composition: 97 parts of a co-polyester resin of fumaric acid and propoxylated bisphenol A, having an acid value of 18 and volume resistivity of $5.1\times10^{16}$ Ω.cm was melt-blended for 30 minutes at 110° C. in a laboratory kneader with 3 parts of Cu-phthalocyanine pigment (Colour Index PB 15:3). A resistivity decreasing substance—having the following structural formula: $(CH_3)_3NC_{16}H_{33}Br$—was added in a quantity of 0.5% with respect to the binder. It was found that—by mixing with 5% of said ammonium salt—the volume resistivity of the applied binder resin was lowered to $5\times10^{14}$ Ω.cm. This proves a high resistivity decreasing capacity (reduction factor:100).

After cooling, the solidified mass was pulverized and milled using an ALPINE Fliessbettgegenstrahlmühle type 100AFG (tradename) and further classified using an ALPINE multiplex zig-zag classifier type 100MZR (tradename). The resulting particle size distribution of the separated toner, measured by Coulter Counter model Multisizer (tradename), was found to be 6.3 μm average by number and 8.2 μm average by volume. In order to improve the flowability of the toner mass, the toner particles were mixed with 0.5% of hydrophobic colloidal silica particles (BET-value 130 $m^2/g$).

An electrostatographic developer was prepared by mixing said mixture of toner particles and colloidal silica in a 4% ratio (w/w) with carrier particles. The tribo-electric charging of the toner-carrier mixture was performed by mixing said mixture in a standard tumbling set-up for 10 min. The developer mixture was run in the development unit (magnetic brush assembly) for 5 minutes, after which the toner was sampled and the tribo-electric properties were measured, according to a method as described in the above mentioned application EP-A-675417, giving q=−7.1 fC, q as defined in said application.

The distance l between the front side of the printhead structure 6 and the sleeve of the magnetic brush assembly 3, was set at 450 μm. The distance between the receiving member support 5 and the back side of the printhead structure 6 (i.e. control electrodes 6*a*) was set to 150 μm and the paper travelled at 1 cm/sec.

All individually addressable shield electrodes were connected to one voltage power supply, such that the same voltage $V_2$ was applied to all of them. The magnitude of the common voltage $V_2$ applied to all of the shield electrodes is given in table 1 below for different tests. All individually addressable control electrodes were connected to one voltage supply at 0 V.

TABLE 1

| Test | $V_2$ | Density |
|---|---|---|
| 1 | 100 V | 125% |
| 2 | 50 V | 114% |
| 3 | 0 V | 100% |
| 4 | −50 V | 88% |
| 5 | −100 V | 68% |

As can be seen from table 1, the resulting image density can be controlled over a wide range by applying a non-zero voltage $V_2$ to each individual shield electrode. The standard density of 100% can even be increased by applying a positive voltage $V_2$ to the shield electrodes.

A sample printout, obtained by setting all shield electrodes at $V_2$=0 V, was scanned to observe density fluctuations. Using the data of table 1, the shield electrode voltage of every aperture was tuned to achieve a theoretical 100% density, for the control electrodes at a voltage level of $V_3$=0 V. After this shield electrode tuning, the overall density of a next printout showed a much better homogeneity in the direction orthogonal to the paper transport direction. For those skilled in the art, it is obvious to store a correction voltage value for each shield electrode in a look up table. This table can then be used while printing varying density information based upon the required image density. Grey scale printing can be achieved either by time-modulation of the voltage applied to the control electrode or by voltage amplitude modulation applied to the control electrode structure.

Having described in detail preferred embodiments of the current invention, it will now be apparent to those skilled in the art that numerous modifications can be made therein without departing from the scope of the invention as defined in the following claims.

I claim:

1. A direct electrostatic printing device for printing images onto a receiving substrate, comprising:

a toner source for providing a cloud of particles of toner; and a printhead structure located proximate to said toner source, said printhead structure having a first side and a second side located so that said first side of said printhead structure is located between said toner source and said second side of said printhead structure, said printhead structure having an array of printing apertures therethrough, each said printing aperture being surrounded by a separately addressable shield electrode on said first side of said printhead structure and being surrounded by a separately addressable control electrode on said second side of said printhead structure, each said separately addressable shield electrode being electrically isolated from every other said separately addressable shield electrode and from each said separately addressable control electrode, each said separately addressable control electrode being electrically isolated from every other said separately addressable control electrode and from each said separately addressable shield electrode, and each said separately addressable shield electrode and each said separately addressable control electrode being capable of having a different voltage applied thereto, said separately addressable shield electrodes and said separately addressable control electrodes being capable of electrically modulating a flow of said particles of toner through said apertures in a direction away from said toner source, so that said printhead structure causes said particles of toner to be deposited onto the receiving substrate to form an image.

2. The direct electrostatic printing device according to claim 1, wherein said printhead structure further comprises a plastic isolation layer located between said first side of said printhead structure and said second side of said printhead structure.

3. The direct electrostatic printing device according to claim 1, further comprising means for applying a time-independent voltage to each said separately addressable shield electrode.

4. The direct electrostatic printing device according to claim 3, wherein said means for applying a time-independent voltage to each said separately addressable shield electrode comprises a memory for storing values corresponding to said time-independent voltages for each said separately addressable shield electrode.

5. The direct electrostatic printing device according to claim 4, wherein said memory comprises a non-volatile memory.

6. The direct electrostatic printing device according to claim 3, wherein said memory comprises a volatile memory.

7. A direct electrostatic printing method for printing images onto a receiving substrate, comprising the steps of:

providing a cloud of particles of toner proximate to an array of printing apertures located in a printhead structure, said printhead structure having a first side and a second side located so that said first side of said printhead structure is located between said cloud of particles of toner and said second side of said printhead structure, each said printing aperture being surrounded by a separately addressable shield electrode on said first side of said printhead structure and being surrounded by a separately addressable control electrode on said second side of said printhead structure, each said separately addressable shield electrode being electrically isolated from every other said separately addressable shield electrode and from each said separately addressable control electrode, each said separately addressable control electrode being electrically isolated from every other said separately addressable control electrode and from each said separately addressable shield electrode, and each said separately addressable shield electrode and each said separately addressable control electrode being capable of having a different voltage applied thereto;

applying a fixed voltage signal to each said separately addressable shield electrode, at least while printing images onto the receiving substrate, said fixed voltage signal being selected from a plurality of voltage signals; and applying a voltage signal to each said separately addressable control electrode to cause said particles of toner to be deposited onto the receiving substrate to form an image, said voltage signals applied to said control electrodes being determined according to the image being printed onto the substrate.

* * * * *

UNITED STATES PATENT AND TRADEMARK OFFICE

CERTIFICATE OF CORRECTION

PATENT NO. : 6,033,056

DATED : March 7, 2000

INVENTOR(S) : Guido Desie

It is certified that error appears in the above-identified patent and that said Letters Patent is hereby corrected as shown below:

Column 2, lines 58–64: lines 58–64 should be re-formatted to read
-- between the receiving member support—which comprises different isolated wires as control back electrode—and the toner delivery unit. For a line printer density can be tuned by selecting an appropriate voltage for shield electrode, control-electrode and control back electrode wire. --;

Column 4, line 16: "device." should read -- device, --;

Column 5, line 58: "means, "such" should read -- means 11, such --;

Column 5, line 60: "means" " should read -- means 11 --.

Signed and Sealed this

Eighth Day of May, 2001

*Attest:*

Nicholas P. Godici

NICHOLAS P. GODICI

*Attesting Officer*

*Acting Director of the United States Patent and Trademark Office*